United States Patent [19]

Abraham, III

[11] Patent Number: 5,009,082

[45] Date of Patent: Apr. 23, 1991

[54] SYSTEM FOR COOLING BEER FOR REMOTE DISPENSING

[76] Inventor: Martin J. Abraham, III, 857 Timber Bend St., Lacombe, La. 70445

[21] Appl. No.: 379,480

[22] Filed: Jul. 3, 1989

[51] Int. Cl.[5] ..... B67D 5/62

[52] U.S. Cl. ..... 62/390; 62/393; 222/146.6

[58] Field of Search ..... 62/389, 390, 393; 222/146.6

[56] References Cited

U.S. PATENT DOCUMENTS

| | | | |
|---|---|---|---|
| 2,076,922 | 4/1937 | Simard | 62/390 X |
| 2,141,221 | 12/1938 | Panagopoulos | 62/393 |
| 2,253,940 | 8/1941 | Peet | 62/393 X |
| 2,342,299 | 2/1944 | Peet | 62/390 |
| 4,437,319 | 3/1984 | Iannelli | 62/399 X |
| 4,676,400 | 6/1987 | Lamont et al. | 62/393 X |
| 4,679,408 | 7/1987 | Nelson | 62/393 X |

*Primary Examiner*—Lloyd L. King

*Attorney, Agent, or Firm*—Pravel, Gambrell, Hewitt, Kimball & Krieger

[57] ABSTRACT

A system for cooling beer to be dispensed from a container housed in a preliminary air cooled environment that is cooled with a primary heat exchanger includes a first flowline for dispensing beer from the container and an auxiliary heat exchanger having a glycol reservoir for receiving the first flowline, the first flowline traversing the reservoir in heat exchange relation therewith. The second flowline includes at least a pair of side-by-side internal bores having a first bore in fluid communication with the first flowline downstream of the glycol reservoir and a second bore carrying glycol from the reservoir in close proximity and in heat exchange relation with beer in the first bore, the second flowline being extended in length so that beer and glycol can travel to remote positions away from the container. A spigot is provided for dispensing the beer at the remote position after transmitted thereto via the second flowline. The first flowline includes one or more fittings forming connections between the container and the reservoir that produce substantially laminar flow between the container and the reservoir.

4 Claims, 3 Drawing Sheets

SYSTEM FOR COOLING BEER FOR REMOTE DISPENSING

BACKGROUND OF THE INVENTION

1. Field of the Invention

The present invention relates to the cooling and dispensing of beer, and particularly to a system for cooling beer which travels over an extended distance from storage (e.g., kegs in a walk-in cooler) for dispensing at a remote location. More particularly, the present invention relates to an improved system for cooling beer to be dispensed from a container (e.g., a keg) housed in a preliminarily air-cooled environment such as a walk-in cooler that is cooled with a primary heat exchanger and wherein the beer travels to a secondary or auxiliary heat exchanger for a preliminary cooling at a glycol reservoir, and subsequently the glycol and beer travel in adjacent but separate bores in heat exchange relationship from the auxiliary heat exchanger, over a substantial distance to the remote location for dispensing. In one embodiment, a tower carries the spigot and has a hollow interior that includes a bore for containing glycol transmitted to the tower via the second flowline, and the second flowline terminates at the tower with multiple vertical runs of a flowline within the tower for transmitting beer to the spigot in heat exchange relation with the glycol in the tower.

2. General Background

Many commercial establishments serve draft beer at a bar area which is located some distance from the storage container, usually housed in a walk-in cooler or the like wherein the beer is kept at a refrigerated temperature with the surrounding cooled air. Many restaurants, for example, will maintain four or five kegs of beer in a walk-in cooler which has such an air-cooled environment. These walk-in coolers typically have their own heat exchanger which hopefully keeps the interior airspace of the cooler, for example, at 35°-40° F. so that anything contained within this walk-in cooler assumes the temperature of the surrounding air-cooled environment. A problem occurs wherein the walk-in cooler is used extensively, such as during peak hours. When this extensive use occurs, the door to the walk-in cooler is opened and closed repeatedly, causing the temperature of air within the cooler to rise which results in a rise of the temperature of goods (e.g., beer kegs) contained within the cooler. Thus, for example, if the cooler is subjected to extensive use, the temperature of the beer inside the kegs which are housed in the cooler can rise to a beginning temperature of, for example, 50°-60° F., or higher. This beginning temperature for the beer at the keg will result in warmer product at the spigot and its tower where the beer is dispensed to the user. This problem can be particularly acute wherein the beer travels from the keg to the spigot a distance of, for example, in excess of one hundred (100) feet.

It has been known to cool beer in flowlines which include multiple bores or lumens and in which a bore carrying beer runs side-by-side a bore carrying coolant. A double bore flowline having one line containing a refrigerant, such as a glycol, and the other line containing the beer is commercially available. The two bores are maintained adjacent one another so that the coolant hopefully maintains a desirably cold condition of the beer between the keg and the spigot. However, if the beer begins at an ambient temperature which is relatively high, such as, for example, 60° F., it may be undesirably hot to the consumer when it reaches the spigot.

Several patents have been issued which relate to the problem of pre-cooling a beer product after it has left the keg. U.S. Pat. Nos. 2,376,373; 2,346,933; and 2,248,637 describe variations of pre-cooling beer after it has left a container or keg but, before it gets to the spigot or tap. These systems do not use the same heat exchanger to both pre-cool the beer before it enters a flowline to the spigot and to provide refrigerant flow to a bore flowing side-by-side in a dual bore line with the beer.

U.S. Pat. Nos. 2,541,709; 2,598,751; 4,437,319; 4,676,400; 2,205,318; and 2,554,322 relate generally to pre-cooling of beer with various heat exchangers before the beer leaves a dispensing tap.

U.S. Pat. No. 2,682,160 discloses a system for pre-cooling beer with cooled water after leaving a container or keg and then again at the tower area in a sump-type relationship.

U.S Pat. No. 4,437,319, issued to F. M. Iannelli, entitled "Beverage Dispensing Device", discloses a beverage cooling device which mounts on top of a cabinet so that a warm beverage, such as beer carried in a keg is cooled prior to flowing out of a faucet. The apparatus includes a cylindrical container having an evaporator coil positioned closely adjacent an inner wall and a beverage dispensing coil centrally positioned within the container. A space is provided between the inner wall of the container and the beverage dispensing coil so as to permit ice to build up on the wall of the container. A power-operated propellor is centrally located within the container for circulating water over the layer of ice and around the beverage dispensing coil to enhance the cooling of the beer flowing through the coil. A temperature sensor is carried in the water between the ice layer and the beverage cooling coil for controlling the operation of a compressor for maintaining the proper temperature of water in the container.

U.S. Pat. No. 4,676,400, issued to Lamont et al, entitled "Liquid Dispensing System", discloses a method and apparatus for dispensing beverages permitting the use of water as a coolant and utilizing parasitic cooling from a walk-in cooler. At least one supply tube for a beverage leads from a container for that beverage through a cooling manifold to a dispensing tap through a conduit assembly. The conduit assembly includes a tube which enwraps one or more beverage lines and a second tube which enwraps the first tube. Coolant passes between the first tube and the beverage lines to keep the beverage lines at a desired temperature from the walk-in cooler to the remote dispensing tap. At the tap, the coolant enters a passage between the first or intermediate tube and the outer tube and returns to the walk-in cooler. In the cooler, there coolant passes through a cooling coil positioned at the discharge for the primary cooler refrigeration system. A pump in the cooler provides the necessary energy to circulate the coolant through the system.

The present invention provides an improved system for cooling beer that is to be dispensed from a container (e.g., a common beer keg) which is housed in a preliminary air-cooled environment, such as a walk-in cooler. The present invention features an auxiliary heat exchanger having a glycol reservoir to preliminarily lower the temperature of the beer being dispensed from the keg or container immediately downstream of the container outlet and prior to transmission of the beer and the glycol beer multibore flowline transmitting beer from the walk-in cooler area to the remote location. Thus, with the present invention, the auxiliary reservoir temperature can determine the preliminary temperature of the beer prior to transmission rather than the air temperature of the walk-in cooler which is subject to rapid temperature fluctuation during peak use.

SUMMARY OF THE PRESENT INVENTION

The present invention provides an improved system for cooling beer to be dispensed from a container (e.g., beer keg) which is housed in a preliminarily air-cooled environment that is cooled with a primary heat exchanger, such as a commercially available, commonly used walk-in type cooler. A first flowline is provided for dispensing beer from the container to an auxiliary heat exchanger having a glycol reservoir. The first flowline traverses the reservoir in heat exchange relation therewith so that the glycol reservoir defines the temperature of the beer prior to transmission to the remote location, rather than the temperature of the beer being defined by the temperature of the air-cooled environment of the walk-in cooler. A second flowline which is transmitted downstream of the auxiliary heat exchange reservoir provides at least of a pair of internal bores including a first bore for carrying beer in fluid communication with the first flowline, and downstream of the glycol reservoir, and a second bore carrying glycol from the reservoir in close proximity and in heat exchange relation with the beer with the first bore, the second flowline being extended in length so that the beer and glycol can travel to remote positions well away from the container. A top or spigot is provided for dispensing beer that has been transmitted via the second flowline to a top or spigot. A glycol return line returns glycol from the spigot area to the reservoir and the first flowline includes fittings and flowlines that form connections and conduits between the container and the reservoir that produce substantially laminar flow between the container and the reservoir.

In the preferred embodiment, the auxiliary heat exchanger and the container are positioned adjacent one another so that the first flowline can be substantially shorter than the second flowline.

In the preferred embodiment, there is further provided a tower carrying the dispensing tap or spigot and having a hollow interior that includes a bore for containing glycol transmitted to the tower via the second flowline, and the second flowline terminates at the tower emptying glycol thereinto. A multiple vertical run third flowline within the tower carries transmitting beer to the spigot in heat exchange relation with the glycol contained within the tower.

In the preferred embodiment, the second flowline includes at least three internal bores having at least two glycol carrying bores and two beer carrying bores.

BRIEF DESCRIPTION OF THE DRAWINGS

For a further understanding of the nature, objects, and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENT

Figure 1:
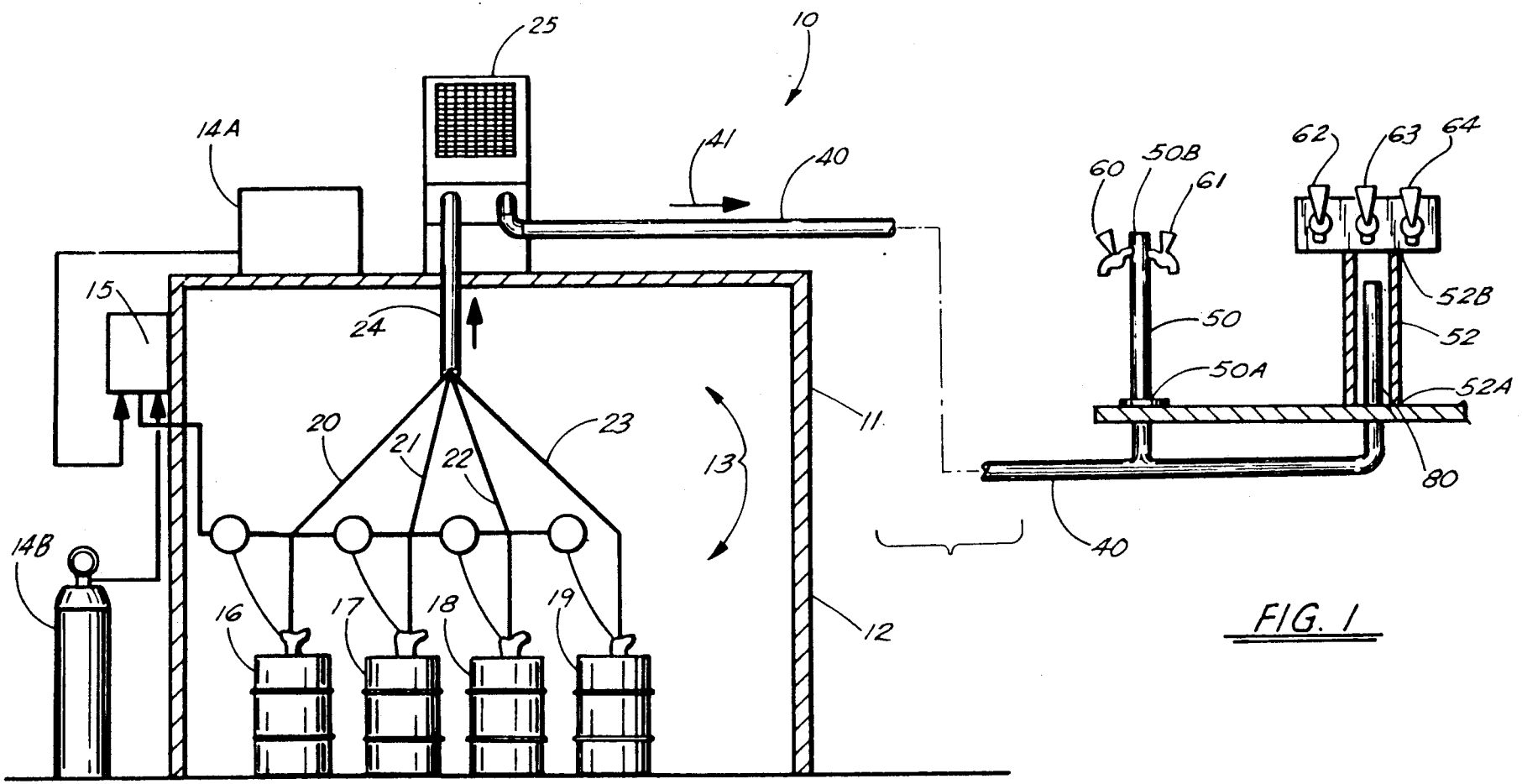
FIG. 1 is a schematic front view of the preferred embodiment of the apparatus of the present invention.

In FIG. 1, there can be seen a schematic illustration of the preferred embodiment of the apparatus of the present invention designated generally by the numeral 10. The system 10 of the present invention is typically used in combination with a walk-in cooler 12, for example, having an interior 13 which is air-cooled with a primary heat exchanger (not shown) for cooling the interior 13. Walk-in cooler 12 and its heat exchanger are commercially available, commonly used devices seen in restaurants, bars and the like.

A plurality of containers 16–19 in the form of kegs of beer, for example, are contained within interior 13 and the beer contained within each container 16–19 assumes the temperature of the interior 13, i.e., the air temperature.

Figure 3:
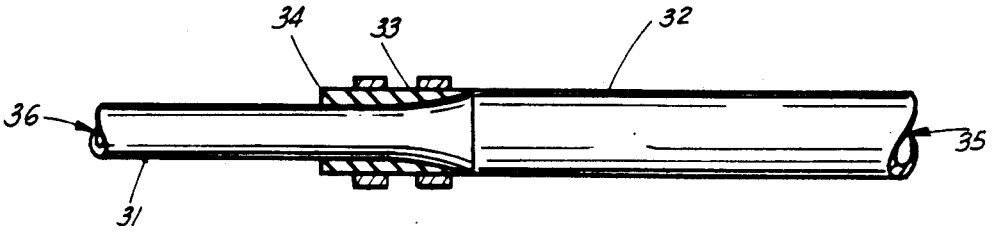
FIG. 3 is a fragmentary view of the preferred embodiment of the apparatus of the present invention illustrating the turbulent free fitting portion thereof.

An air compressor 14A and $CO_2$ tank 14B communicate with $CO_2$/air blender 15 to provide pressure for dispensing beer via a plurality of flowlines 20–23 which extend from each container 16–19 to primary flowline 24 and then to auxiliary heat exchanger 25. In FIG. 3, there can be seen a fragmentary construction of the flowlines 24 connections such as between metallic (e.g., stainless steel) tubing 31 and plastic (for example, polyethylene) tubing 32 in order to provide substantially laminar and non-turbulent flow from containers 16–19 to auxiliary heat exchanger 25. The metallic tubing 31 provides a swaged end portion 33 which defines an enlarged diameter and a preload for receiving tubing 32 end portion 34. The overriding plastic tubing slightly compresses the swaged 33 end of metallic tubing 31 to its original diameter to thus provide a substantially constant, circular cross section in the bore of tubing 31, 31 between 35 and 36 which schematically illustrates end portions of flowlines 20–23 and 24, to prevent the creation for turbulent flow for beer which passes from containers 16–19 to auxiliary heat exchanger 25.

The flowlines 20–23 are joined or banded together in a common primary flowline 24 so that a primary flowline enters the auxiliary heat exchanger 25 for addition to the reservoir portion thereof.

A secondary flowline 40 exits auxiliary heat exchanger 25, as illustrated by the arrow 41 in FIG. 1, and flows over, for example, one hundred (100) plus feet, to dispensing towers 50, 52, each of which contains one or more spigots 60–64, for dispensing beer product at a remote location. Towers 50, 52 can be generally cylindrical in shape, each having a generally cylindrical hollow interior 53.

Figure 8:
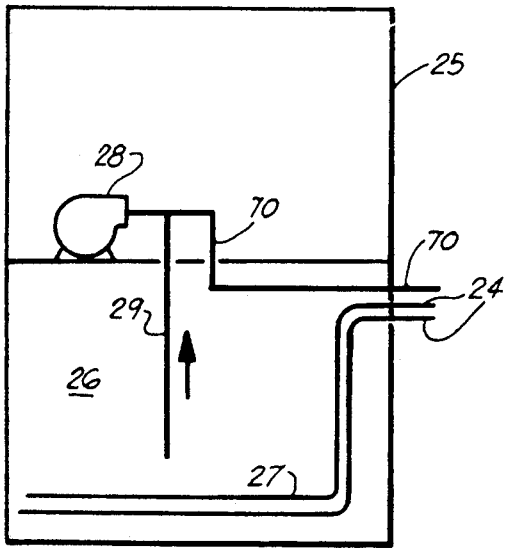
FIG. 8 is a fragmentary view of the preferred embodiment of the apparatus of the present invention illustrating the auxiliary heat exchanger in side view including the circulating pump.

Auxiliary heat exchanger 25 is illustrated in more detail in FIGS. 8 (side view) and 9 (front view). Auxiliary heat exchanger 25 includes a lowermost glycol reservoir 26 and a plurality of stacking, spiralling beer coils 27 placed within glycol reservoir 26 and extend therethrough providing heat exchange relationship between the beer in line 24 (that communicates with coils 27) and the glycol contained within reservoir 26. With the present invention, the auxiliary heat exchanger defines the temperature of beer which leaves the cooler interior 13 area and is transmitted over, for example, one hundred to one hundred fifty (100–150) feet of distance, to the tops or spigots 60–64.

Figure 4:
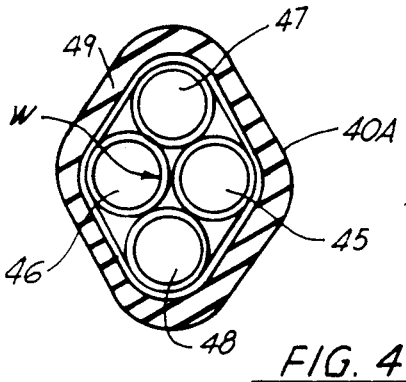
FIG. 4 is a fragmentary sectional view of the preferred embodiment of the apparatus of the present invention illustrating the secondary flowline with a two-product line configuration.
Figure 5:
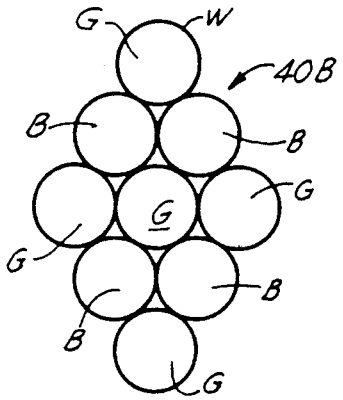
FIG. 5 is a fragmentary view illustrating an alternate arrangement of the second flowline with a four-product line configuration.
Figure 6:
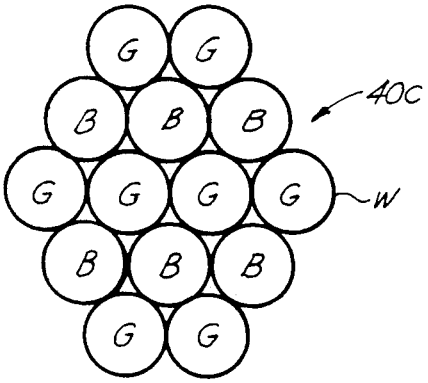
FIG. 6 is another sectional fragmentary view of the preferred embodiment of the apparatus of the present invention illustrating another layout of the secondary flowline portion thereof with a six-product line configuration.
Figure 9:
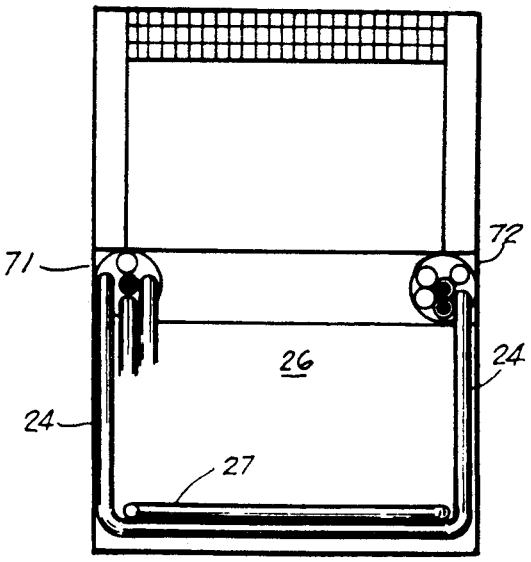
FIG. 9 is a fragmentary view of the preferred embodiment of the apparatus of the present invention illustrating the auxiliary heat exchanger in frontal view.

Pump 28 provides a suction line 29 for lifting glycol and transmitting it via glycol line discharge 70 into a close heat exchange relationship with the beer lines as part of secondary flowline 40 (see FIGS. 4–6). In FIG. 9, inlet fitting 71 allows line 24 to enter reservoir 26 and communicate with the plurality of coils 27 contained within reservoir 26. Flowline 24 thus communicates with the plurality of coils 27 contained in glycol reservoir 26 so that heat exchange relationship can take place between the beer in coils 27 and the reservoir. The beer contained within the flowlines 24 and 27 can thus reach a desirably low temperature being close to or equal to the temperature of the glycol reservoir, for example, below 40° F. By making the glycol reservoir 26 of a desired design volume, glycol can recirculate to and from towers 50, 52 several times per hour to maximize heat transfer and maintain a very low constant temperature of the beer. The line 24 communicates with fitting 72 which is an exit fitting containing the plurality of separate beer and glycol bores B, G in heat exchange relation to one another but not in fluid communication so that the glycol and beer do not mix. The fitting 72 thus communicates with flowline 40 which is a secondary flowline carrying a plurality of bores B, G, including bores B carrying the beer which has now been cooled by the reservoir 26 and some bores B carrying the glycol which is transmitted via glycol discharge line 70. In FIG. 4, secondary flowline 40A provides a plurality of four internal bores including bores 45 and 46 carrying gylcol and bores 47, 48 carrying beer so that each bore 47–48 carrying beer is positioned adjacent and in heat exchange relation with the bores 45, 46 carrying glycol. An external housing 49 can be, for example, of aluminum foil tape with outer foam insulation thereon, for maintaining a substantially constant temperature as the beer and glycol mixture are transmitted from the auxiliary heat exchanger 25 to the spigots 60–64. The foil tape is placed continuously along the length of line 40, 40A, 40B, and 40C to maintain the configuration of beer and glycol lines B, G throughout the length of the secondary flowline.

In the embodiment of FIG. 5, designated by the numeral 40B, a plurality of nine bores are illustrated schematically including a plurality of lines carrying beer designated by the letter B, and a plurality of lines carrying gylcol designated by the letter G.

In the embodiment of FIG. 6, a plurality of fourteen fluid carrying bores are provided for line 40C, including a plurality of bores carrying glycol designated by the letter G, and a plurality of bores carrying beer designated with the letter B. In each of the embodiments of FIGS. 4–5, it should be understood that each bore is defined by a generally cylindrical conduit cross section having a wall W of sufficient structural integrity for carrying beer and glycol respectively under pressure.

Figure 7:
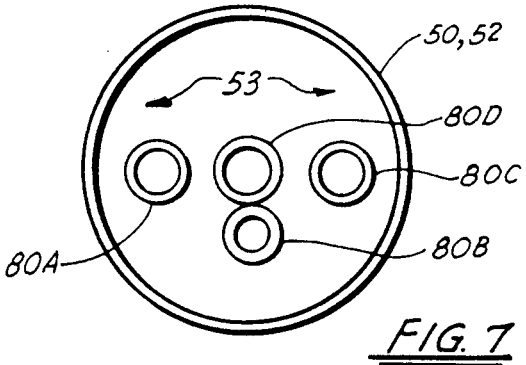
FIG. 7 is a fragmentary view of the preferred embodiment of the apparatus of the present invention illustrating a vertical sectional view of the tower portion thereof.

In FIG. 7, there can be seen towers 50, 52 in section as containing a generally cylindrical internal space 53 which is open and which continuously circulates glycol during use. The towers 50, 52 are sealed at their lower respective end portions 50A, 52A, and at their upper respective end portions 50B, 52B, thus defining a vessel with a generally cylindrical interior 53 that is filled with glycol during use. A third flowline 80 includes, for example, multiple vertical runs 80A, 80B, 80C, 80D, so that the beer can flow upwardly and downwardly multiple times within the towers 50, 52 in heat exchange relation with glycol contained within the tower interior 53. In this fashion, beer is also cooled at the tower area and also maintains a balanced system in that pressure and flow rate are properly regulated because the vertical lines are preferably smaller "choker" lines, e.g., 3/16" stainless (I.D.). The present invention thus provides a system with three sequential defined heat exchange areas, including the auxiliary heat exchanger 25 at reservoir 26, the secondary flowline 40 which includes bores B and G carrying respectively beer and glycol in close wall-to-wall relationship, as indicated in FIGS. 4–6, and thirdly at the towers 50, 52 wherein glycol is contained within the confines of the tower interior 53 and wherein beer is transmitted upwardly and downwardly within multiple vertical runs 80–80D of the third flowline.

The present invention has thus been found to successfully carry beer very long distances of, for example, in excess of 100 feet, to remote locations for dispensing and with very little loss of temperature from that defined by the reservoir of the auxiliary heat exchanger.

Figure 2:
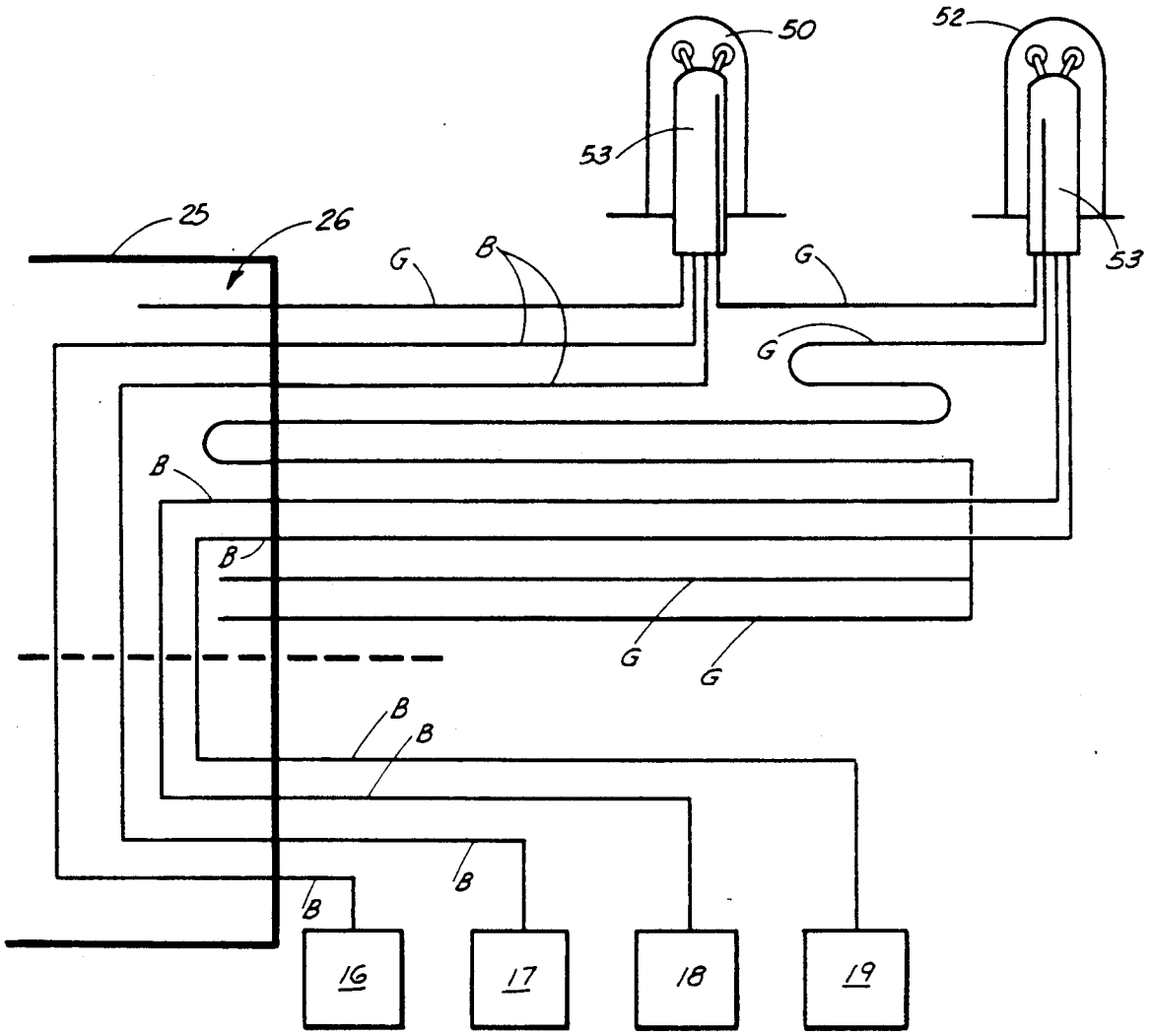
FIG. 2 is a schematic view of the preferred embodiment of the apparatus of the present invention illustrating the flowline layout portion thereof.

In FIG. 2, a schematic illustration of an exemplary layout provides four containers or kegs 16–19 supplying beer to a pair of towers 50–52 with beer carrying bores being designated by the letter B, and glycol bores being designated by the letter G for purposes of illustration.

In view of the numerous modifications which could be made to the preferred embodiments disclosed herein without departing from the scope or spirit of the present invention, the details herein are to be interpreted as illustrative and not in a limiting sense.

What is claimed as invention is:

1. A system for cooling beer to be dispensed from a container comprising:

(a) a cooled housing with an interior having a preliminarily air-cooled housing with an interior having a preliminarily air-cooled environment that is cooled to a first temperature below ambient temperature with a primary heat exchanger; p1 (b) a first flowline for dispensing beer from the container;

(c) an auxiliary heat exchanger having a glycol reservoir for receiving the first flowline, and the first flowline including multiple stacked coils of the first flowline within the reservoir in heat exchange relation therewith;

(d) a second flowline comprising at least a pair of internal bores including a first bore in fluid communication with the first flowline downstream of the glycol reservoir and a second bore carrying glycol from the reservoir in close proximity and in heat exchange relation with beer in the first bore, the second flowline being extended in length so that beer and glycol can travel to remote positions away from the container;

(e) a spigot for dispensing beer at the remote position that has been transmitted thereto via the second flowline;

(f) means for returning the glycol to the reservoir; and (g) the first flowline having one or more fittings forming connections between the container and the reservoir that produce substantially laminar flow between the container and the reservoir.

2. The system to claim 1, wherein the auxiliary heat exchanger and the containers are positioned adjacent one another, with the auxiliary heat exchanger outside of the cooled housing interior.

3. The system of claim 1, further comprising a tower carrying the spigot and having a hollow interior that includes a bore for containing glycol transmitted to the tower via the second flowline and the second flowline terminates at the tower with a multiple vertical run flowline within the tower transmitting beer to the spigot in lot exchange relation with glycol in the tower.

4. The system of claim 1, wherein the second flowline includes at least three internal bores including at least two glycol carrying bores and two glycol carrying bores wherein each beer carrying bore is in contact with two glycol carrying bores.

* * * * *